US006127003A

United States Patent [19]

Fukuda et al.

[11] Patent Number: 6,127,003

[45] Date of Patent: Oct. 3, 2000

[54] METHOD OF COATING A SUBSTRATE INCLUDING A CHARGING STEP AND APPARATUS FOR CARRYING OUT THE METHOD

[75] Inventors: Kazuhiro Fukuda; Yuichiro Maehara, both of Hino, Japan

[73] Assignee: Konica Corporation, Japan

[21] Appl. No.: 09/179,566

[22] Filed: Oct. 27, 1998

[30] Foreign Application Priority Data

Oct. 31, 1997 [JP] Japan ..... 9-300530

[51] Int. Cl.[7] ..... B05D 3/14

[52] U.S. Cl. ..... 427/535; 427/540; 427/569; 427/580; 427/458

[58] Field of Search ..... 427/458, 540, 427/535, 569, 580; 361/221; 118/620

[56] References Cited

U.S. PATENT DOCUMENTS 3,671,806 6/1972 Whitmore et al. ..... 317/3

FOREIGN PATENT DOCUMENTS 055 983 A2 7/1982 European Pat. Off. .
530 752 A1 3/1991 European Pat. Off. .

*Primary Examiner*—Katherine A. Bareford
*Attorney, Agent, or Firm*—Jordan B. Bierman; Bierman, Muserlian and Lucas

[57] ABSTRACT

In a method of coating a first surface of a web, a second surface of the web reverse to the first surface is charged, wherein a surface specific resistance of the second surface is $10^{12}$ Ω·cm or less.

16 Claims, 13 Drawing Sheets

METHOD OF COATING A SUBSTRATE INCLUDING A CHARGING STEP AND APPARATUS FOR CARRYING OUT THE METHOD

BACKGROUND OF THE INVENTION

The present invention relates to a coating method which achieves thin-layer coating on a web and a coating apparatus therefore.

Heretofore, as a method of coating a coating liquid onto a web, U.S. Pat. No. 4,457,256 is known. This method is to conduct coating and improve wettability for reducing the layer thickness at high speed after providing voltage applying processing with the web which is subjected to dielectric polarizing. However, according to this method, when the coating liquid is coated on aforesaid web subjected to aforesaid dielectric polarization, the direction of polarization becomes diversified due to influence by the coating liquid, resulting in uneven coating. In addition, there was also a problem that coating speed could not be increased.

Further, in TOKUKAIHEI No. 2-293072, TOKUKAIHEI No. 2-293071, TOKUKAIHEI No. 3-501702 and TOKUGANSHO No. 61-146369, a method to conduct coating while a web is applied with a voltage. However, with such a method, uneven charging takes place, result in uneven coating.

SUMMARY OF THE INVENTION

An objective of the present invention is to overcome the above-mentioned problems and to provide (a) a coating method capable of increase wettability (the degree of wet condition) and reducing coating unevenness and a coating apparatus using the same and (b) a coating method capable of improving the coating speed and a coating apparatus using the same.

The above-mentioned objective described in item (a) above is attained by the following constitution.

1) In a coating method, the following steps are provided:
   - a step of conducting electrical charging on a web whose specific surface resistance of the surface opposite to the surface being coated is $10^{12}$ Ω·cm or less; and
   - a step of coating a coating liquid onto the above-mentioned web.
2) in a coating apparatus for applying a coating liquid onto a web, the following constitutions are provided:
   - a charging means for charging a web whose specific surface resistance on the surface opposite to the surface being coated is $10^{12}$ Ω·cm or less; and
   - a coating means for applying a coating liquid onto the above-mentioned web.

In addition, aforesaid objective described in above-mentioned item (b) is attained by the following constitutions.

3) In a coating method which coats a coating liquid onto a long web being conveyed continuously, coating is conducted by controling a potential of electrical field on a liquid contact section formed between the web and the coating liquid to be 200–3000 V by a charging means.
4) A coating device for applying a coating liquid onto a web, having the following constitutions;
   - a coating means for applying a coating liquid onto a web; and
   - a charging means to conduct charging in such a manner that an electrical field potential at an interface section or a liquid contact section between the web and the coating liquid is 200 V or more and 3000 V or less.

BRIEF DESCRIPTION OF THE DRAWINGS

FIG. 21(*a*) shows a case when the web is conveyed linearly. FIG. 21(*b*) shows a case in which an air-back-up roller conveys the web.

DETAILED DESCRIPTION OF THE PREFERRED EMBODIMENT

An embodiment of the present invention will now be explained.

Figure 1:
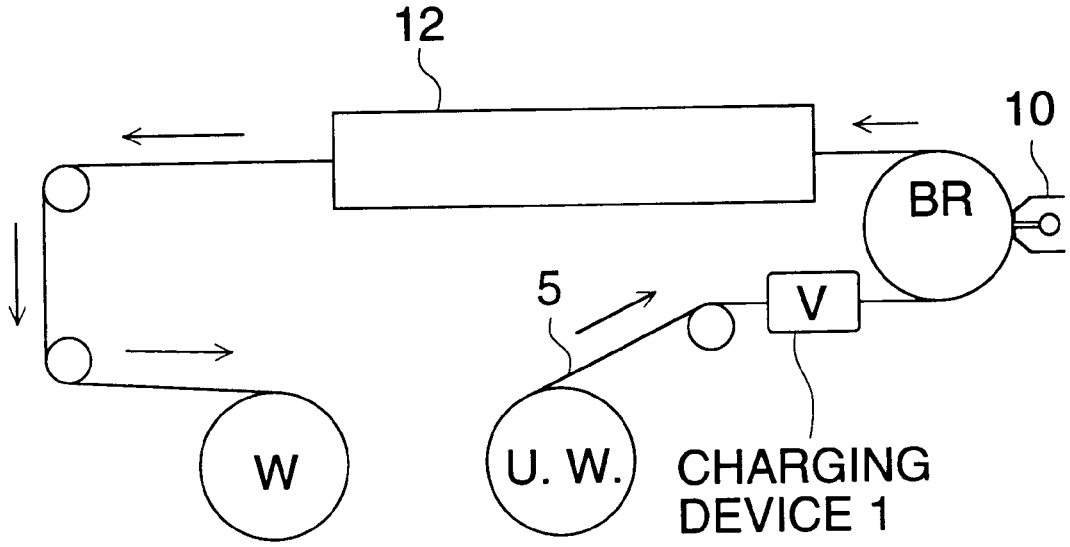
FIG. 1 is a schematic side view explaining one embodiment of a coating method of the present invention and a coating device using the same.

FIG. 1 is a side view for explaining one embodiment of a coating method and a coating apparatus according to the present invention.

While aforesaid long roll of band-shaped web is conveyed by a conveyance means, it is electrically charged thereon by charging device 1 provided upstream of the coater used as a coating means. After that, on a back-up roller arranged so a sto face the coater, a coating liquid is applied onto the web by aforesaid coating means. By means of a drier, the coating liquid applied on aforesaid web is dried.

It is preferable that charging device 1 charges the web in such a manner that the electrical field potential (charging potential) on the web at the interface section being a position on the web where the coating liquid fed from the coater contacts the web becomes 200–3000 V. As far as 200 V or higher, the higher the preferable, since wettability can be improved. By increasing the potential to 2000 V or higher, coating at high speed can be attained. If the potential is 3000 V or lower, the occurrence of light emission or sparking at the interface between the web and the coating liquid and, further, instability of the potential following aforesaid phenomenon can be minimized. If the potential is less than 2000 V, attraction of dust particles onto the surface of the back-up roller can be minimized, and transfer problems can also be minimized.

It is desirable that the surface of the back-up roller be polished a mirror surface. It is preferable that the center line average roughness on a section where the surface of the back-up roller contacts the web is 0.8 S or less.

Figure 2:
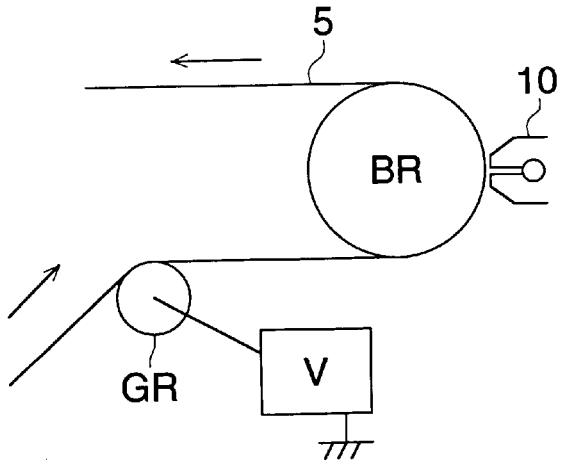
FIGS. 2, 3 and 4 are respectively side views showing an Example of charging device 1.
Figure 3:
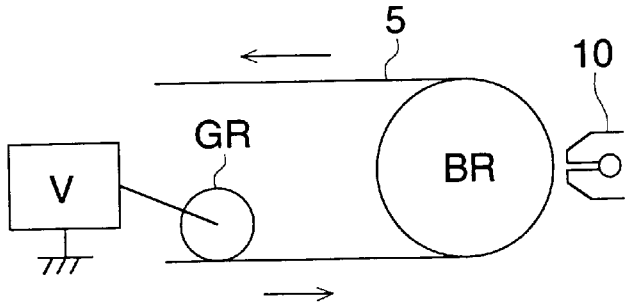
Figure 4:
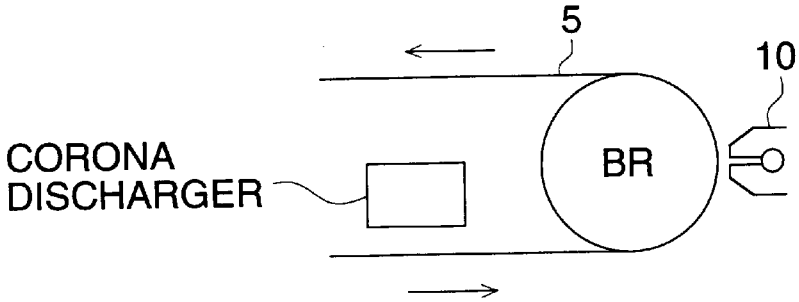

Charging device 1 may be any of several means as far as it charges the web, including a contact type voltage-applying roller which conducts charging onto the web while directly contacting the web as shown in FIGS. 2 and 3 or a corona discharger as shown in FIG. 4.

Specifically, in the case of corona discharging, by charging the web from the side opposite to the coates surface of the web, since electric charge is accumulated at the side opposite to the coates surface of the web, uneven charging caused by the phenomenon that charge located in the vicinity of the surface of the coated side of the web is moved under the influence of the coating liquid at the time of coating can be reduced, whereby uneven coating can be also reduced.

To the contrary, if a contact type voltage applying roller is used, the essential charging effect on the web can be obtained at a voltage lower than the corona discharging, therefore the occurrence of ozone can be reduced. In addition, if aforesaid contact type voltage applying roller is used, light emission can be inhibited. Therefore, it is specifically preferable if a light-sensitive material is used for coating. In addition, as the contact type voltage applying roller, it is preferable to use a metal roller. As aforesaid roller, it is preferable to use ones having a width wider than the web. In addition, if an applying line is used, coating unevenness can be reduced by reducing the width perpendicular to a length of the applying line to 2 mm or less.

Figure 5:
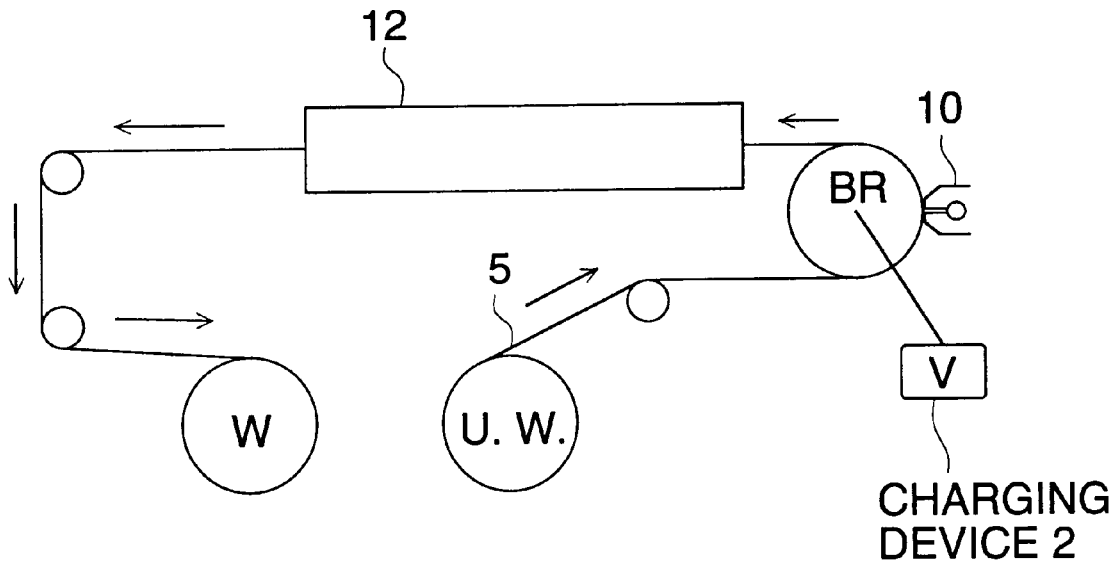
FIG. 5 is a side view showing an Example of charging device 2.

As shown in FIG. 5, as another embodiment of the charging means, due to charging the back-up roller facing the coater by the use of charging device 2, it is possible to charge the web from the side opposite the surface facing the coater immediately before applying the coating liquid onto the web while having it directly contact the web. In this occasion, since the web is charged immediately before being coated onto the web, it is preferable that any coating unevenness due to the occurrence of charging unevenness and the movement of charge on the web can further be reduced owing to the fact that the web contacts the rollers inside the apparatus after charging.

If rollers are provided as supporting means which contact the web between the charging means and the coating means, it is preferable to coat the coating liquid under which rollers are electrically insulated in order to maintain the charge of the charged web on the web. It is more preferable to cause all rollers which contact the web provided between the charging means and the coating means to be insulated. Insulating methods include, as described in Japanese Tokkaihei No. 2-251266, a method to conduct lamination using ceramic and also a method employing ceramic bearings. In addition, it is preferable to laminate the surface of the rollers with an insulating resin such as Teflon and rubber, specifically with a high dielectric insulating substance, or to manufacture the rollers with an insulating resin such as Teflon and rubber, specifically with a high dielectric insulating substance. It is further preferable to use the ceramic since the accuracy of the rollers can be improved. It is desirable to electrically neutralize the rollers, which contacts the web, provided between the charging means and the coating means, at the end of coating. For this purpose, it is preferable that the dielectric ratio of the insulating resin be 7 or more. In addition, it is also preferable that the specific volume resistance be $10^{10}$ Ω·cm or more. With regard to aforesaid material, alumna-containing ceramic can be manufactured relatively easily. The thickness is preferably 10 μm or more, and more preferably 50 μm or more. Due to setting aforesaid thickness, it is possible to enhance the insulating property. In order to attain aforesaid effects overwhelmingly and effectively, it is desirable to laminate at least the back-up roller, as a supporting means, located facing the coating means.

With regard to a roller laminated with a high dielectric insulating substance, a ceramic roller may be used. In the ceramic roller, ceramic was sprayed as a lamination onto a metal base roller wherein the sum of convex/concave portions of trapezoid-shaped grooves formed on the circumference are less than the pitch of the grooves and aforesaid pitches are 0.5–2 mm and then aforesaid laminated ceramic is polished to a prescribed finish. By using the ceramic roller, the occurrence of problems on meandering of the web due to air inclusion can be minimized. whereby, since a ceramic roller can be used in high speed conveyance, thin layer coating at high speed can be conducted stably. Ceramics usable here may include powder types (alumna, alumna-titania, titania, chromia and zirconia) used in a plasma-powder-spray method or rod-types (chromium oxide) used in a rhokide rod spray method. No specific materials are required.

With regard to a web, as described above, it is preferable that the surface specific resistance of the surface which is opposite the surface being coated, i.e., a surface facing the coater be $10^{12}$ Ω·cm or less. It is additionally preferable that the specific resistance ratio inside the substrate other than the surface thereof be $10^{10}$ Ω·cm or more and that the thickness be 25 μm or more.

In the present invention, the surface specific resistance is a measurement value following JIS 6911, and the volume specific resistance is a measurement value by means of a three-terminal method.

The present invention will be explained referring to Examples.

EXAMPLE 1-1

Using Charging Device 1

As shown in FIG. 2, guiding roller GR which guides web 5 is electrically insulated. Direct voltage was applied on aforesaid insulated guiding roller GR, which was used as charging device 1.

Figure 6:
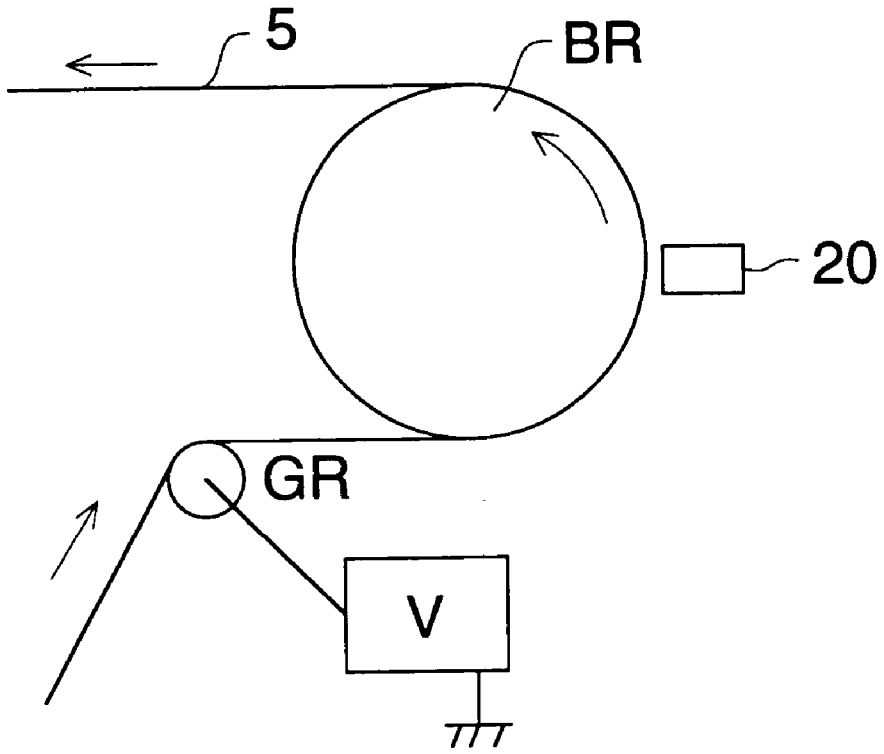
FIG. 6 is a side view showing how to measure the charging amount on the web at charging device 1.

As the charging amount of the web charged by aforesaid charging device 1, as shown in FIG. 6, aforesaid charging amount on the web on back-up roller BR was measured using surface potential measuring device 20 (TREK/Model 341), with back-up roller BR being insulated at the bearing sections.

Figure 7:
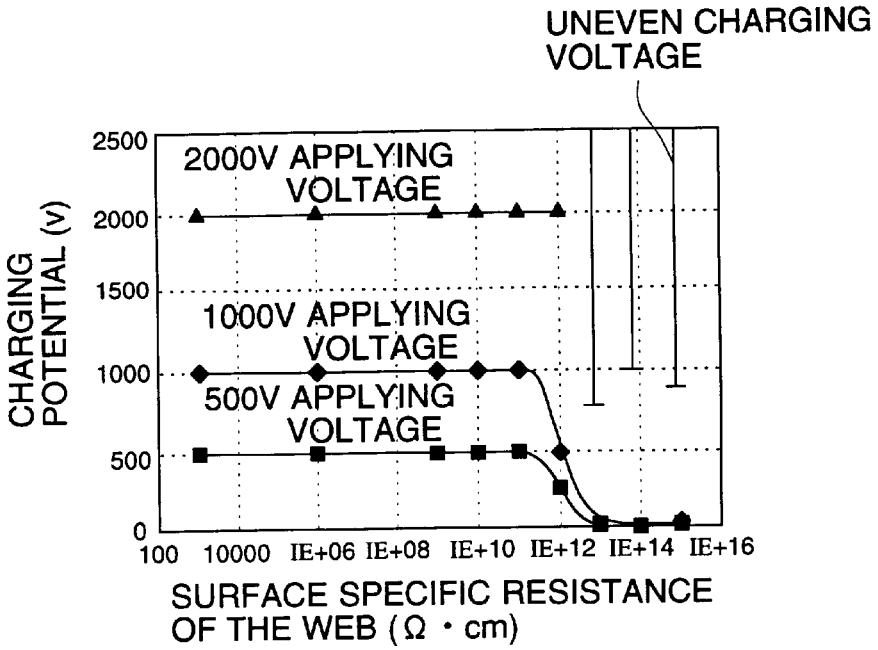
FIG. 7 is a graph showing the relationship between the surface specific resistance of the web and the charging potential.

As is apparent from FIG. 7, which shows the results of the charging amount measured, charges can effectively be conveyed if a web has a surface specific resistance of $10^{12}$ Ω·cm or less.

Figure 8:
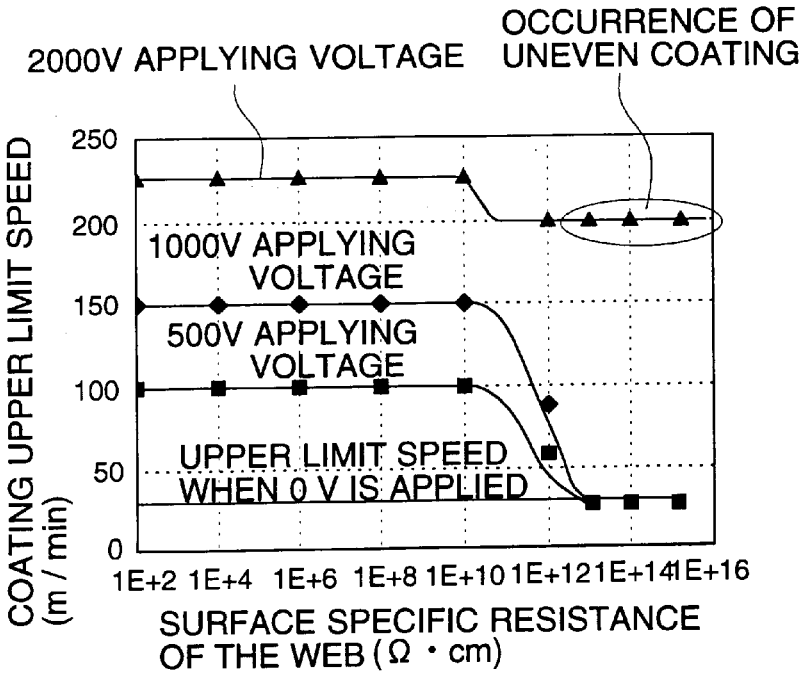
FIG. 8 is a graph showing the relationship between the surface specific resistance of the web and the coating critical speed.

Next, by the use of a coating device with the constitution described in FIG. 2, coating liquid with gelatin of 1% (viscosity of 1 cp) was coated in which the thickness of 10 μm. By increasing the coating speed, the critical speed at which the bead was broken and coating could not be conducted was measured. FIG. 8 shows the relationship between aforesaid critical speed and the volume specific resistance of the web. As should be understood by FIG. 8, uneven coating could be reduced and high speed coating could be attained when a web whose surface specific resistance was $10^{12}$ Ω·cm or less was used.

EXAMPLE 1-2

Using Charging Device 2

Figure 9:
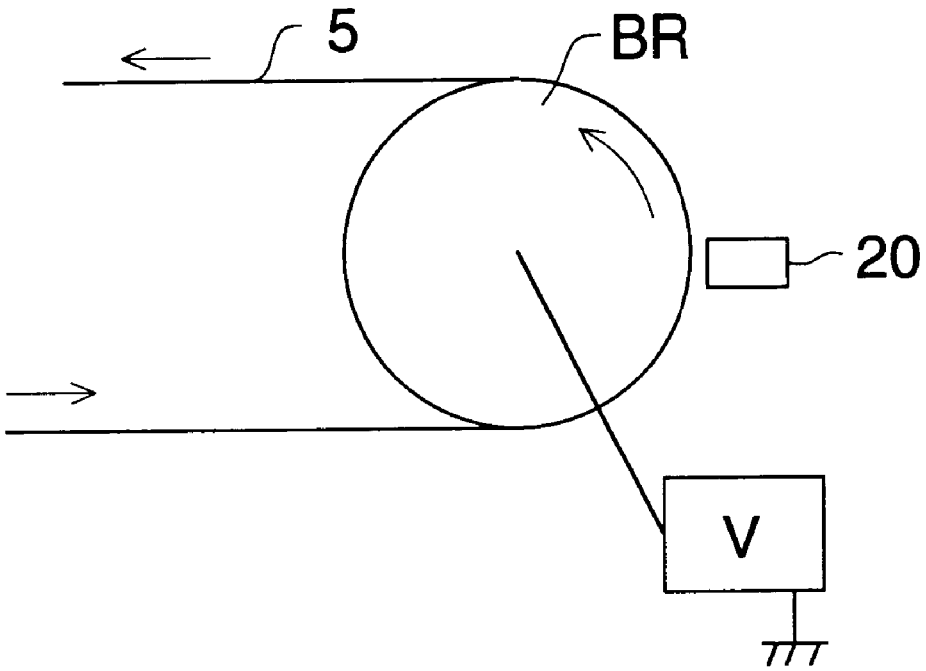
FIG. 9 is a side view showing how the measured charging amount on the web at charging device 2.
Figure 10:
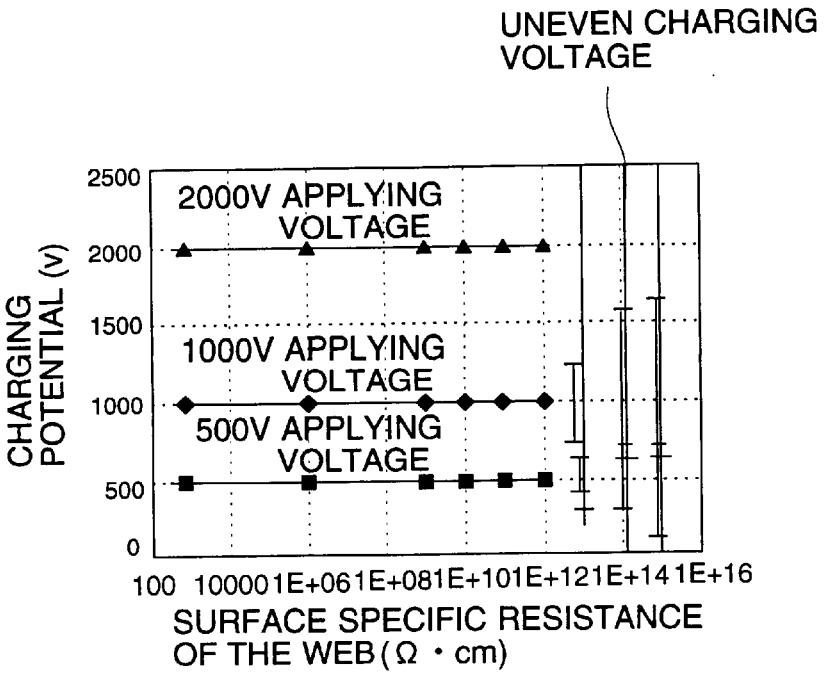
FIG. 10 is a graph showing the relationship between the surface specific resistance of the web and the charging potential.

As described in FIG. 9, direct voltage was applied on guiding roller GR insulated at the bearing section, which was used as charging device 2. The charging amount of the web charged by aforesaid charging device 2 on back-up roller BR was measured. As should be apparent from FIG. 7 which shows the results of the charging amount measured, uniform potential was detected on back-up roller BR, if a web having a surface specific resistance of $10^{12}$ Ω·cm or less was used.

Figure 11:
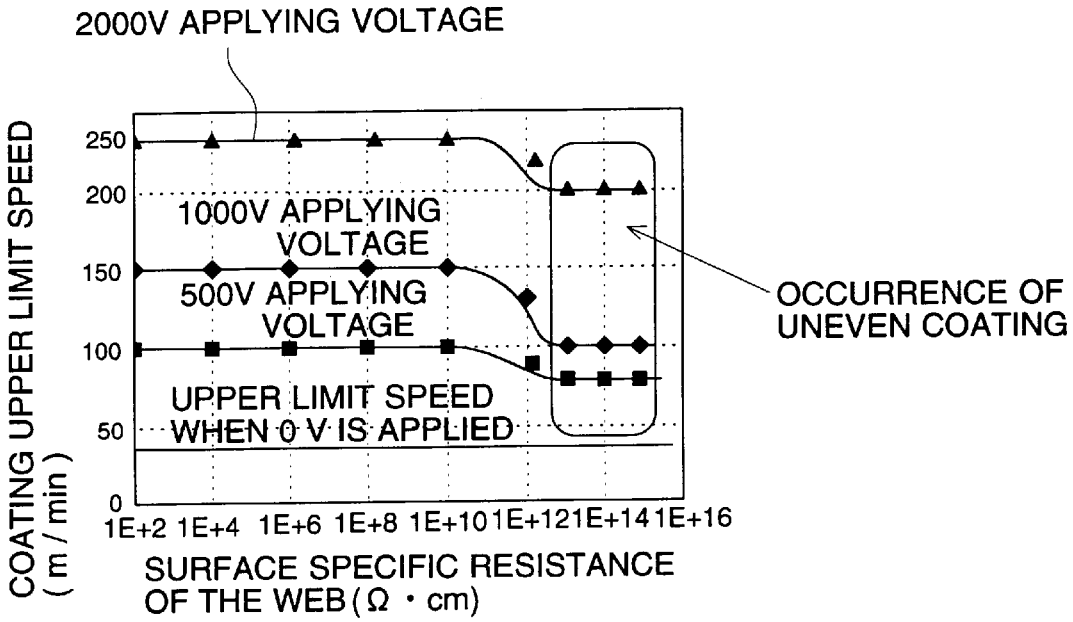
FIG. 11 is a graph showing the relationship between the surface specific resistance of the web and the coating critical speed.

Next, in the same manner as in Example 1-1, coating liquid with gelatin of 1% (viscosity of 1 cp) was coated to a thickness was 10 μm by the coating apparatus shown in FIG. 5. By increasing the coating speed, the critical speed in which the bead was broken and coating could not be conducted was measured. As is understood from FIG. 11, uneven coating can be reduced by the charging method of the present invention so that high speed coating could be attained.

Due to controlling the surface specific resistance on the side of the web opposite the coating side to be $10^{12}$ Ω·cm or less in accordance with the present invention, charges provided is distributed uniformly on the web and the occurrence of uneven coating due to uneven charge can be inhibited. As a result, wettability was improved, whereby layer reduction at high speed was attained. In addition, uniformly coated layer was obtained.

In order to arrange the surface specific resistance on the side of the web opposite the coating side to be $10^{12}$ Ω·cm, a web produced by depositing or coating a conductive layer satisfying the specifications may be used, or a web in which the side which is opposite the coated surface had already been coated due to double-sided coating may be used.

EXAMPLE 2

Figure 12:
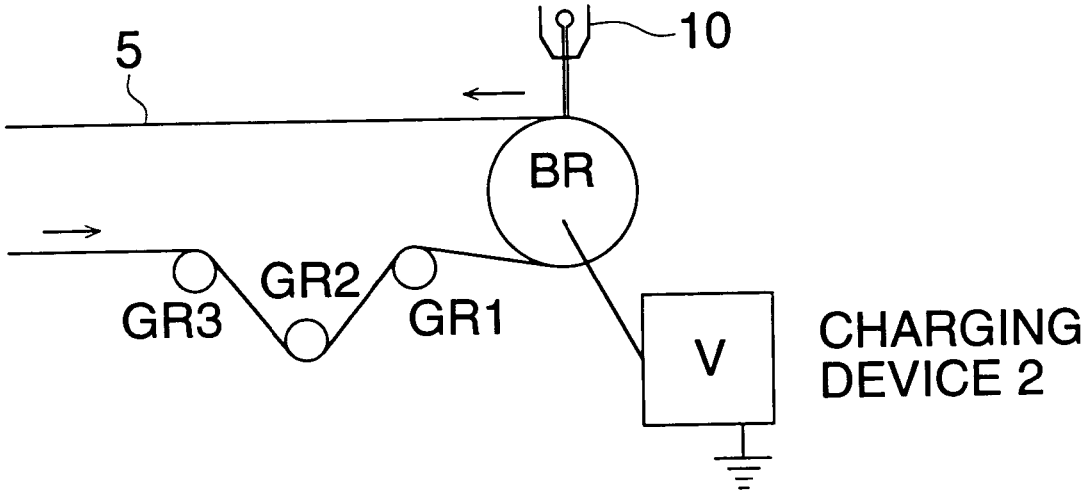
FIG. 12 is a side view showing an Example in which charging device 2 is applied to curtain coating.

Not being limited to the method wherein aforesaid long band-shaped web whose specific surface resistance on the surface opposite to the coated surface is $10^{9}$ Ω·cm is electrically charged by the use of charging device 2 immediately before the above-mentioned coating, wettability improvement can be attained by forming an electrical field at the interface section between aforesaid web and the coating liquid. Under the following conditions, coating by means of a curtain coating method in which the constitution is shown in FIG. 12 was conducted.

Coating speed: 100–500 m/min

Gelatin: 15% solution (a prescribed activator is contained)

Coated layer thickness: 60 μm

Figure 13:
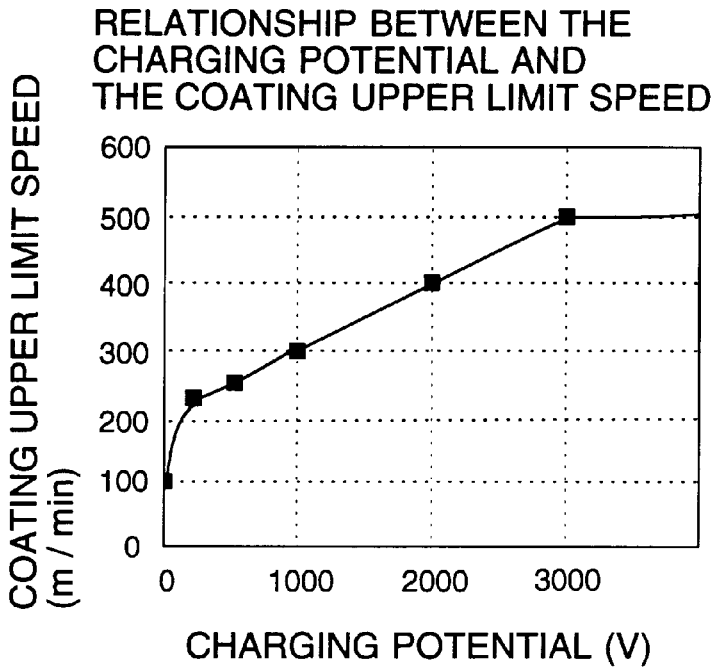
FIG. 13 is a graph showing the relationship between the charging potential and the coating critical speed.

As a result, as shown in FIG. 13, by arranging the potential difference necessary for improving wettability to be 200 V or higher and, by arranging aforesaid potential difference to be 3000 V or less, coating can be conducted without causing light emission and sparking.

EXAMPLE 3

Figure 14:
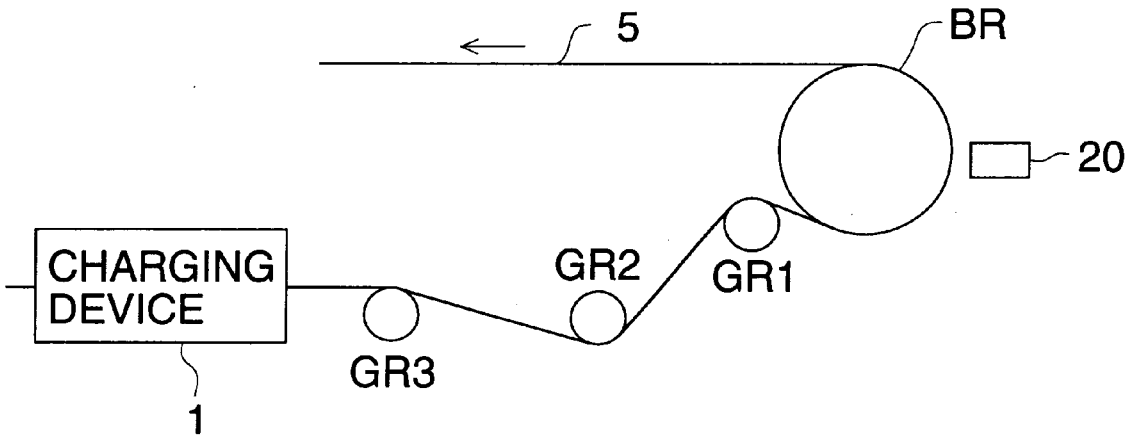
FIG. 14 is a side view showing the location of each roller which conveys the web.

As shown in FIG. 14, guiding rollers GR1, GR2 and GR3 for conveyance and back-up roller BR were provided. An experiment was conducted under the same condition as Example 1-1 except that all rollers were insulated. Reduction of the charging potential on back-up roller could be lightened, and thereby uneven coating could be reduced.

EXAMPLE 4

If charging voltage at the interface section is applied at 3000 V or less under the same conditions as in Example 1-1, thin layer coating at high speed can be attained. In addition, by laminating the surface of at least one roller, either charging device 1 or back-up roller BR, with a high dielectric insulating substance, the occurrence of problems such as light emission and sparking as described above can be minimized.

EXAMPLES 5 AND 6

Figure 15:
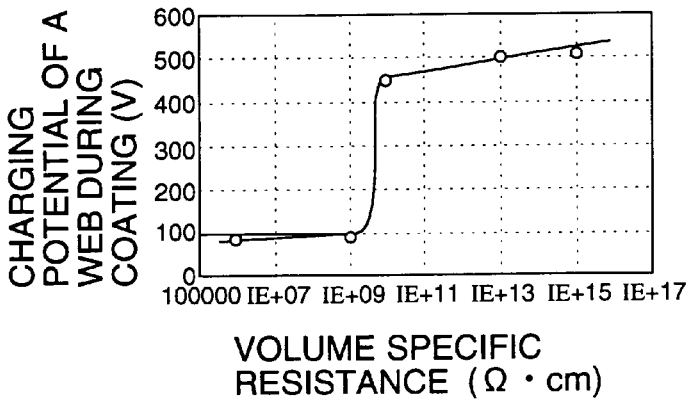
FIG. 15 is a graph showing relationship between the volume specific resistance of the roller-laminating substance and the potential of the web during coating.
Figure 16:
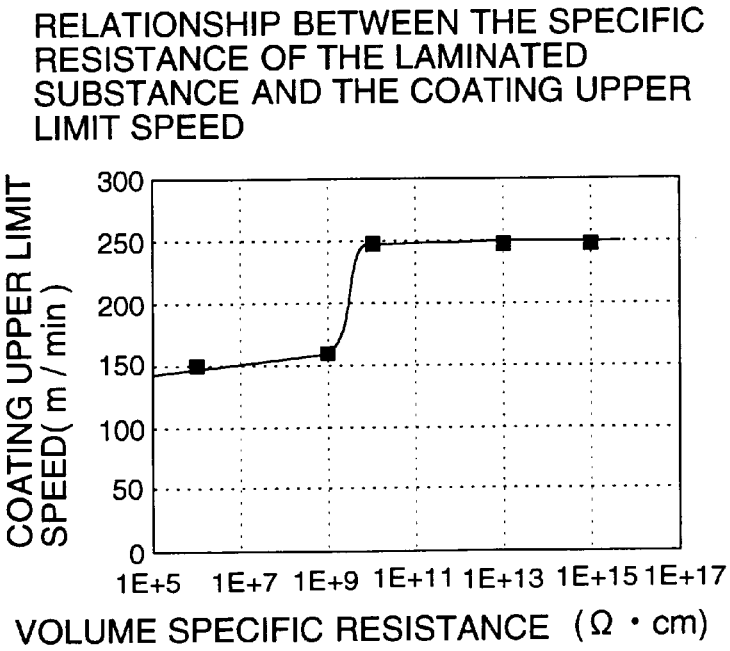
FIG. 16 is a graph showing the relationship between the volume specific resistance of the roller-laminating substance and the coating upper limit speed.

Here, by the use of a coating device having a constitution shown in FIG. 14, the volume specific resistance ratio is changed due to laminating guiding roller GR1 with an alumina-containing ceramic, a chromium oxide-containing ceramic and a zirconia-containing ceramic, and then, 1 kV was applied by means of a charging device. Aforesaid guiding roller GR1 was replaced with aforesaid ceramic roller for installation. Thus, charging potential during coating was measured. As shown in FIG. 15, if the volume specific resistance ratio was $10^{10}$ Ω·cm or more, it turned out that the reduction of the potential of the indicator was small and a potential could be maintained between 400–500 V. With regard to the respective volume specific resistance ratio, the critical speed in which the bead is broken and coating cannot be conducted is measured. FIG. 16 shows the results thereof. As should be understood from FIG. 16, by arranging a volume specific resistance ratio of $10^{10}$ Ω·cm or more, coating speed can be improved.

In addition, in the case of resin-laminated rollers with a dielectric ratio of 7 or more, electrical charge uniformly remains in aforesaid laminated section, due to which, uneven coating could be decreased.

EXAMPLE 7

Figure 17:
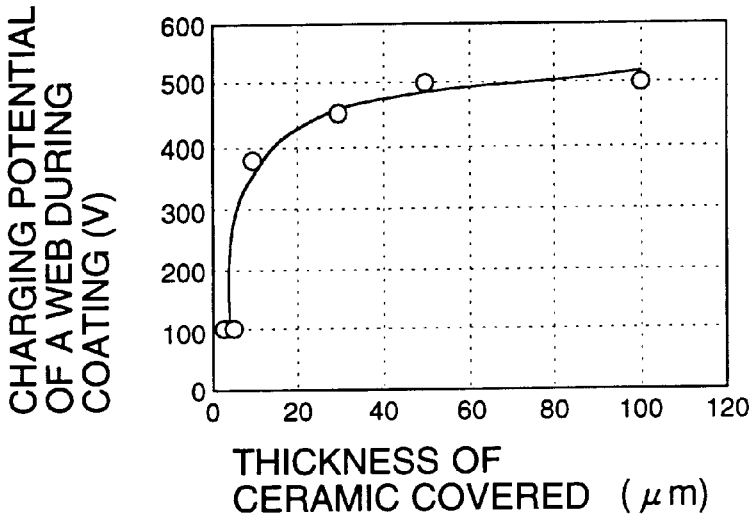
FIG. 17 is a graph showing the relationship between the thickness of a layer laminated onto a ceramic-surface roller and the potential of the web during coating.
Figure 18:
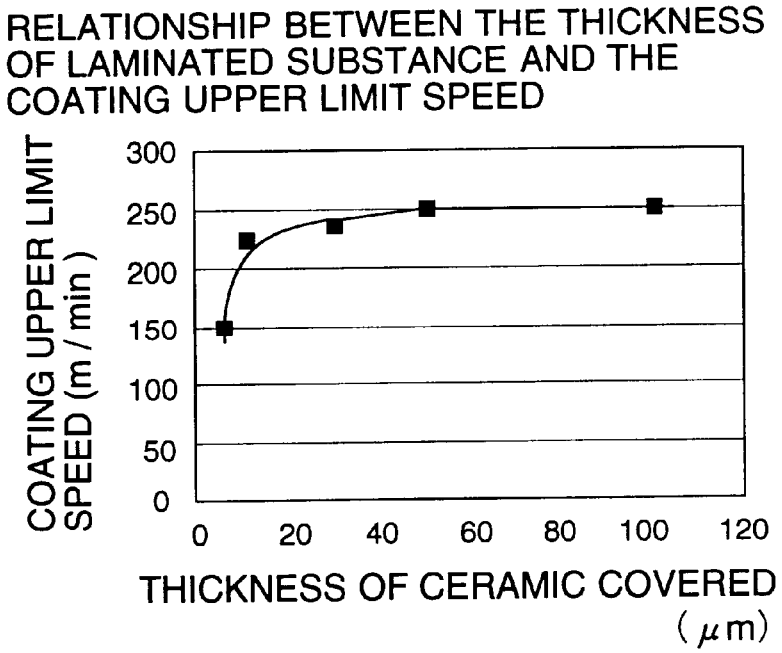
FIG. 18 is a graph showing the relationship between the thickness of the laminating layer and the coating upper limit speed.

An experiment was conducted under conditions identical to Example 6, in which an alumina-containing ceramic was used as a high dielectric insulating substance. As shown in FIG. 17, when the above-mentioned high dielectric insulating substance is used and the thickness of the laminated thickness is 10 μm or more, it turned out that reduction of the potential of the indicator becomes small and aforesaid high dielectric insulating substance can be reduced to 400–500 V. With regard to respective laminated layer thickness, the critical speed at which the bead is broken and coating cannot be conducted is measured. FIG. 18 shows the results thereof. As is understood from FIG. 18, by arranging a laminated layer thickness be 10 μm or more, uneven coating can be reduced and coating speed can be improved. If the laminated layer thickness is desirably 50 μm or more, it was confirmed that sufficient voltage maintenance effects can be provided and coating speed can additionally be improved.

EXAMPLE 8

Figure 19:
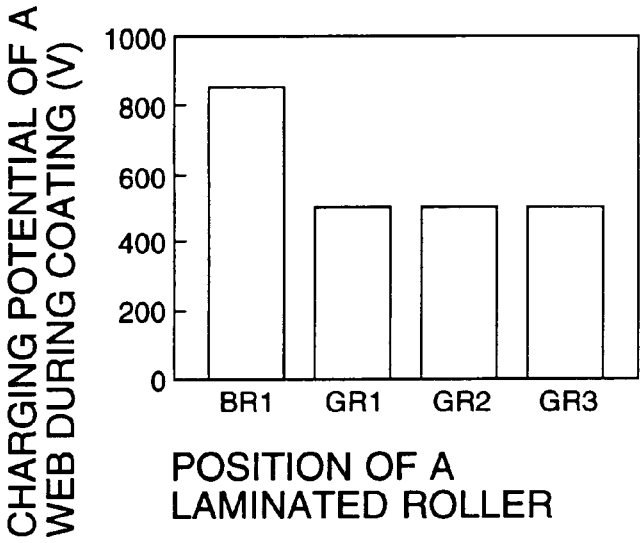
FIG. 19 is a histogram showing which roller provided with high dielectric insulating laminating material can maintain the charged potential of the web during coating.

In addition, as shown in FIG. 19, if a roller laminated with a high dielectric insulating substance was used for backup roller BR, it was confirmed that the charge leakage specifically on the web is inhibited. Due to this, coating speed can further be improved.

In addition, in aforesaid situation, it was confirmed that an effect to inhibit a side-step shaped uneven uneven problem which occurs when the coating liquid splashes on back-up roller BR.

Example 9 is an apparatus which combines methods described in Examples 1 through 8. Any further explanation is omitted.

EXAMPLE 10

Figure 20:
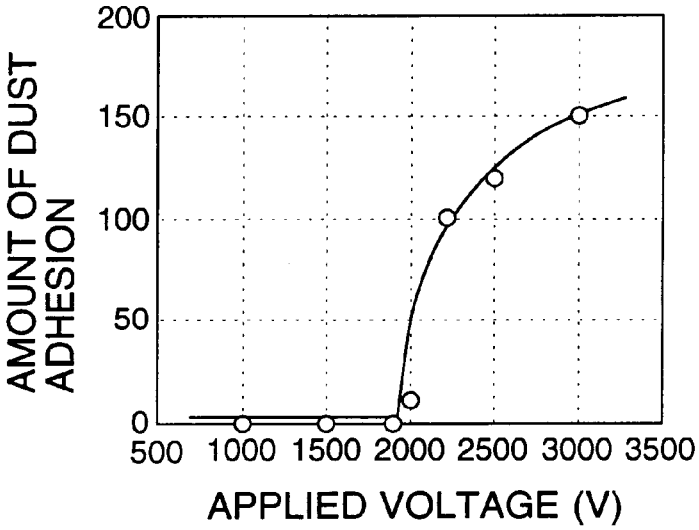
FIG. 20 is a graph showing the relationship between the voltage applied onto the roller and the amount of dust applied.

This is a conventional method which applies a coating liquid on a long roll web continuously running after causing aforesaid web to be wound by back-up roller BR, in which wettability is improved by forming an electrical field between aforesaid long roll band-shaped web and the coating liquid. In this method, since coulomb attracting force is proportional to the square of the electric field strength when aforesaid electric field strength is increased, it is common that, if the charging amount of back-up roller BR is increased, the desired effects are also increased. On the contrary, if the charging amount is increased, dust in ambient air and carried into the apparatus after being adhered on the surface of the web is adhered on the surface of back-up roller BR. Due to this, there occurs a problem that a transfer problem is caused. The present inventors laboriously continued study on aforesaid problem. As a result, as shown in FIG. 2, the present inventors measured the amount of dust adhered on the surface of back-up roller BR1 (per 10 cm×10 cm) under a condition that the web was continuously conveyed for 24 hours without being coated. As a result, as shown in a graph of FIG. 20, it was discovered that dust adhesion can be restrained by setting the charging amount of back-up roller BR1 at 2000 V or less. It is more desirable to polish the surface of aforesaid backup roller BR1 to mirror finish as 0.8 S or less. In addition, by arranging the applying voltage at 200 V or higher, wettability improvement effect can also be obtained.

EXAMPLE 11

Ordinarily, with regard to the conveyance-use of each roller for high speed conveyance and as a back-up roller, it is known that, if the surface thereof is mirror-shaped, air is involved between the roller and the conveyed web, causing meandering and problems in terms of conveyance property. As a countermeasure therefor, methods to subject the surface of roller is subjected to matting or to grooving is applied. However, in the case of the former method (the matting method), there is a limit in terms of increased speed. Therefore, it is considered that the latter method (the grooving method) is superior. However, though the ceramic-laminated roller is excellent in terms of anti-abrasion property, grooving is further difficult due to its hardness. Therefore, it was completely impossible to manufacture a ceramic roller excellent in terms of high speed conveyance property. However, the present inventors discovered that manufacturing of a groove-provided ceramic roller excellent in terms of high speed conveyance property becomes possible easily by providing groove processing having a prescribed form in advance on a base metal roller, laminating ceramic by means of thermal spraying after that and subjecting the roller to polishing finishing as the final finishing.

The coating method was extremely improved due to using aforesaid rollers.

EXAMPLE 12

The present inventors discovered the following. Namely, due to providing insulating conveyance roller GR1 which finally contacts a surface of aforesaid web to be coated and applying voltage directly on aforesaid roller upstream in terms of the conveyance direction in the coating step, though the applied voltage is small, the same or enhanced effects can be attained. In addition, without creating product deterioration such as scratches, coating by means of a voltage applying method in which ozone occurrence is decreased and wettability is improved.

EXAMPLE 13

By the use of the coating method described in Example 12, double-sided coating can stably be conducted.

EXAMPLES 14 AND 15

If there is non-uniformity in terms of surface energy on the surface of a web, it is ordinary that a problem of unevenness derived from it was difficult to be inhibited even if wettability was improved by means of the voltage applying method. However, as described in a side view of FIG. 21(*a*), against web 5 conveyed linearly, charging member 3 was provided in a lateral direction of the web at the symmetrical position with interface point 11 on a side opposite coater 10. By applying voltage on charging member 3, even if aforesaid surface energy of the web is un-uniform, wettability is improved and unevenness can be inhibited.

EXAMPLES 16 AND 17

Figure 21:
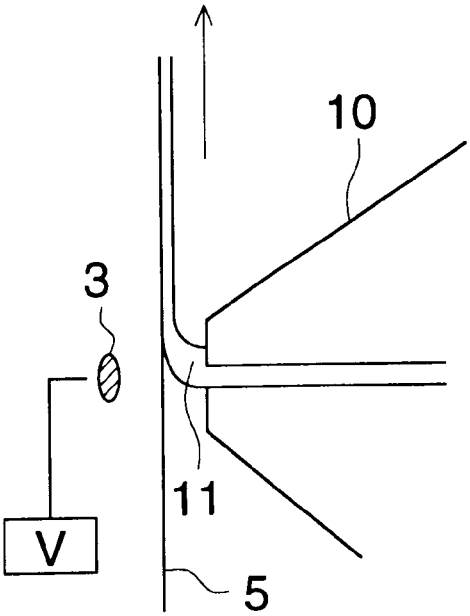
FIGS. 21(*a*) and 21(*b*) are respectively side views showing a situation in which a charging member is provided in a lateral direction of the web on the side of the web opposite the coating side.
Figure 21:
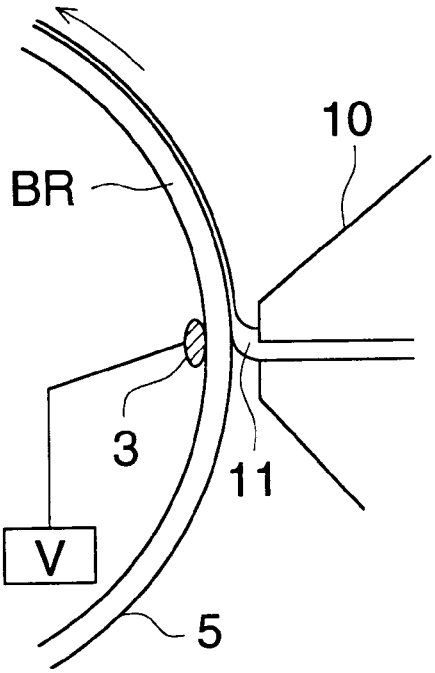

As shown in a side view of FIG. 21(*b*), web 5 is conveyed under conditions that it is wound by air-back-up roller BR2 uncontactly. Aforesaid air-back-up roller BR2 is provided unrotatably. Charging member 3 was provided in aforesaid air-back-up roller BR, in a lateral direction of the web at the symmetrical position with interface point 11 on a side opposite coater 10. By applying voltage on charging member 3, even if aforesaid surface energy of the web is not uniform, wettability is improved and unevenness can be inhibited.

Due to the constitution of the present invention described above, the following effects can be obtained. Electrical potential of a web when voltage is applied is stabilized. In addition, electrical discharging is invariably restrained. Fogging problem on a light-sensitive material is not evident. Thus, thin layer coating at high speed could be smoothly conducted.

Dust adhesion can be restrained. Transfer problem and uneven coating caused due to dust were solved.

The occurrence of meandering problem of a web due to air invasion was overcome. A ceramic roller bearing high speed conveyance could be used. High speed thin layer coating could be conducted stably.

Voltage-applying potential on a web is further stabilized and becomes effective. Charge unevenness and fogging following such are minimized. In addition, double-sided coating could be conducted rationally.

Charging in a lateral direction of the web was maintained uniformly. Therefore, coating problems such as uneven coating was overcome.

What is claimed is:

1. A method of coating a first surface of a web comprising:

charging a second surface of the web opposite the first surface, wherein a surface specific resistivity of the second surface is $10^{12}$ Ω·cm or less, and coating the first surface of the web with a coating solution after or while charging the second surface.

2. The method of claim 1 wherein coating is conducted while the web is conveyed.

3. The method of claim 2 wherein the charging is conducted by a charging roller which comes in contact with the second surface of the web.

4. The method of claim 3 wherein said roller is metallic.

5. The method of claim 2 wherein the coating is conducted while the web is supported by a supporting member which is electrically insulated.

6. The method of claim 2 wherein the coating is conducted while the web is supported by a supporting member which is covered with a high dielectric insulating material.

7. The method of claim 2 wherein the coating is conducted with a coater while the web is supported by a back-up roller which is located opposite to the coater and is electrically insulated.

8. The method of claim 2 wherein the charging is conducted at an electric field potential of 200 to 3000 V at a contact section of the coating solution with the web.

9. The method of claim 1 wherein the charging is conducted from the first surface side.

10. The method of claim 1 wherein the charging is conducted from the second surface side.

11. The method of claim 1 wherein the coating takes place after the charging.

12. In a method for coating a first surface of a web with a coating solution, the improvement comprising:

charging a second surface of the web opposite the first surface before or during coating of said first surface with said coating solution, wherein the second surface has a surface specific resistivity of $10^{12}$ Ω·cm or less.

13. The method of claim 12 wherein the charging is conducted from the first surface side.

14. The method of claim 12 wherein the charging is conducted from the second surface side.

15. The method of claim 12 wherein the charging is conducted by a charging roller which comes in contact with the second surface of the web.

16. The method of claim 15 wherein said roller is metallic.

* * * * *